US008979972B2

(12) United States Patent
Chung et al.

(10) Patent No.: US 8,979,972 B2
(45) Date of Patent: Mar. 17, 2015

(54) METHOD FOR MANUFACTURING METAL FLAKES

(75) Inventors: Kwang Choon Chung, Yongin-si (KR); Hyun Nam Cho, Gunpo-si (KR); Dong Rip Kim, Anyang-si (KR); Ji Hoon Yoo, Bucheon-si (KR)

(73) Assignee: Inktec Co., Ltd. (KR)

( * ) Notice: Subject to any disclaimer, the term of this patent is extended or adjusted under 35 U.S.C. 154(b) by 372 days.

(21) Appl. No.: 13/060,857

(22) PCT Filed: Aug. 24, 2009

(86) PCT No.: PCT/KR2009/004704

§ 371 (c)(1),
(2), (4) Date: Feb. 25, 2011

(87) PCT Pub. No.: WO2010/024564

PCT Pub. Date: Mar. 4, 2010

(65) Prior Publication Data

US 2011/0154948 A1 Jun. 30, 2011

(30) Foreign Application Priority Data

Aug. 25, 2008 (KR) ..... 10-2008-0083087

(51) Int. Cl.
*B22F 9/04* (2006.01)
*B22F 9/30* (2006.01)
*B22F 1/00* (2006.01)

(52) U.S. Cl.
CPC ..... *B22F 9/30* (2013.01); *B22F 1/0055* (2013.01); *B22F 9/04* (2013.01)
USPC ..... 75/345; 75/352; 75/354

(58) Field of Classification Search
None
See application file for complete search history.

(56) References Cited

U.S. PATENT DOCUMENTS

| | | | | |
|---|---|---|---|---|
| 4,482,374 | A | 11/1984 | Osborn et al. | |
| 6,863,851 | B2 * | 3/2005 | Josephy et al. | 264/81 |
| 2006/0117988 | A1 | 6/2006 | Mikhael et al. | |
| 2006/0207385 | A1 | 9/2006 | Goia et al. | |
| 2008/0206488 | A1 * | 8/2008 | Chung et al. | 427/596 |
| 2009/0120800 | A1 * | 5/2009 | Chung et al. | 205/263 |
| 2011/0027402 | A1 | 2/2011 | Josephy et al. | |
| 2013/0022761 | A1 | 1/2013 | Chung et al. | |

FOREIGN PATENT DOCUMENTS

| | | |
|---|---|---|
| CN | 101010388 | 8/2007 |
| JP | 2001026801 | 1/2001 |
| JP | 2005510629 | 4/2005 |
| JP | 2005-281819 | 10/2005 |

(Continued)

OTHER PUBLICATIONS

Machine Translation of KR 10-0529752, published Nov. 17, 2005.*

*Primary Examiner* — George Wyszomierski
(74) *Attorney, Agent, or Firm* — Cantor Colburn LLP

(57) ABSTRACT

Disclosed herein is a method of manufacturing a metal flake, including the steps of: applying metal ink containing an organic metal compound onto a substrate; calcining the metal ink applied on the substrate to form a thin metal film; separating the formed thin metal film from the substrate; and pulverizing the separated thin metal film. The method of manufacturing a metal flake is characterized in that the thickness and size of metal flakes can be easily adjusted, metal flakes having excellent conductivity and gloss can be obtained, and metal flakes can be mass-produced using environmentally friendly and economical methods.

22 Claims, 3 Drawing Sheets

(56) References Cited

FOREIGN PATENT DOCUMENTS

| | | |
|---|---|---|
| JP | 2005-0034371 | 10/2006 |
| JP | 2007-084860 | 4/2007 |
| JP | 2007-254845 | 10/2007 |
| JP | 2008530001 | 8/2008 |
| JP | 2008202076 | 9/2008 |
| KR | 10-0529752 | 11/2005 |
| KR | 10-0658492 | 12/2006 |
| KR | 10-0727451 | 6/2007 |
| KR | 10-0727466 | 6/2007 |
| WO | 2007093401 | 8/2007 |
| WO | 2010/024564 | 3/2010 |

* cited by examiner

METHOD FOR MANUFACTURING METAL FLAKES

CROSS REFERENCE TO RELATED APPLICATIONS

This application is a U.S. national stage of application No. PCT/KR2009/004704, filed on Aug. 24, 2009, which claims priority to KR 10-2008-0083087 filed on Aug. 25, 2008. The disclosures of these related applications are incorporated herein by reference.

BACKGROUND OF THE INVENTION

1. Technical Field

The present invention relates to a method of manufacturing metal flakes, and, more particularly, to a method of manufacturing metal flakes using metal ink containing organic metal compounds.

2. Description of the Related Art

Among metals, silver (Ag), which is a precious metal, has been utilized for various purposes such as decorations, coins, tableware, electric home appliances, electric and electronic appliances, illumination, copiers, display electrodes, electromagnetic wave shielding, antibacterial actions and the like because of its special characteristics such as excellent electroconductivity, excellent antibacterial effects and the like. High-quality, low-cost products have recently become popular while electric and electronic products have become more varied and complex.

Currently, most metal particles such as silver particles, copper particles, nickel particles, aluminum particles and the like, which are mainly used in electric and electrical products, have a sphere or flake shape, and their shapes are selected depending on their uses. Generally, metal particles are prepared by an atomization method, electrochemical method or chemical reduction method. In this case, most of the fabricated metal particles have a spherical shape. The spherical metal particles obtained in this way are formed into metal flakes using a ball mill (U.S. Pat. No. 4,482,374, U.S. Pat. No. 4,859,241, U.S. Pub. No. 2006-0207385, JP-A-2007-84860 and JP-A-2007-254845) or using vacuum deposition (U.S. Pub. No. 2006-0117988 and JP-A-2005-281819). Such metal flakes can be widely used for conductive paste or conductive adhesives for electromagnetic wave shielding or electrodes requiring high conductivity, paint or ink requiring glosses or special colors, coloring pigments for cosmetics, and the like.

Meanwhile, the method of forming spherical metal particles into metal flakes using a ball mill, which is a most generally used technology, is advantageous in that it enables the mass production of metal flakes relatively easily, but is problematic in that technologies for preparing spherical metal particles are required in order to form metal flakes having uniform thickness and size and in that it is difficult to form metal flakes having various thicknesses and excellent surface gloss.

Further, to date, metal flakes have been formed using metal coating methods, such as plating, sputtering, plasma deposition, chemical vapor deposition (CVD), atomic layer deposition (ALD), electro-deposition, etc. This method is advantageous in that the metal flakes obtained by this method have uniform thickness and excellent gloss, but is problematic in that processes are complicated, costs are relatively high and the mass production of metal flakes is difficult.

Therefore, the method of manufacturing metal flakes according to the present invention is characterized in that it is easy to adjust the thickness and size of metal flakes, it is possible to form metal flakes having excellent particle characteristics such as conductivity, gloss and the like, and it is possible to mass-produce metal flakes using environmentally friendly and economical methods.

SUMMARY OF THE INVENTION

As described above, the conventional method of manufacturing metal flakes has several problems in that processes are complicated, costs are high and the particle characteristics of metal flakes deteriorates. Accordingly, the present invention provides a method of manufacturing metal flakes, by which the thickness and size of metal flakes can be easily adjusted, metal flakes having excellent conductivity and gloss can be obtained, and metal flakes can be mass-produced using environmentally friendly and economical methods.

Further, the present inventors found that the thickness, gloss and electrical characteristics of metal flakes can be changed according to the coating method, the kind of a substrate and the concentration of metal ink used for coating. Based on this finding, the present invention was completed.

In order to accomplish the above object, an aspect of the present invention provides a method of manufacturing metal flakes, including the steps of: applying metal ink containing an organic metal compound onto a substrate; calcining the metal ink applied on the substrate to form a thin metal film; separating the formed thin metal film from the substrate; and pulverizing the separated thin metal film to form a metal flake.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
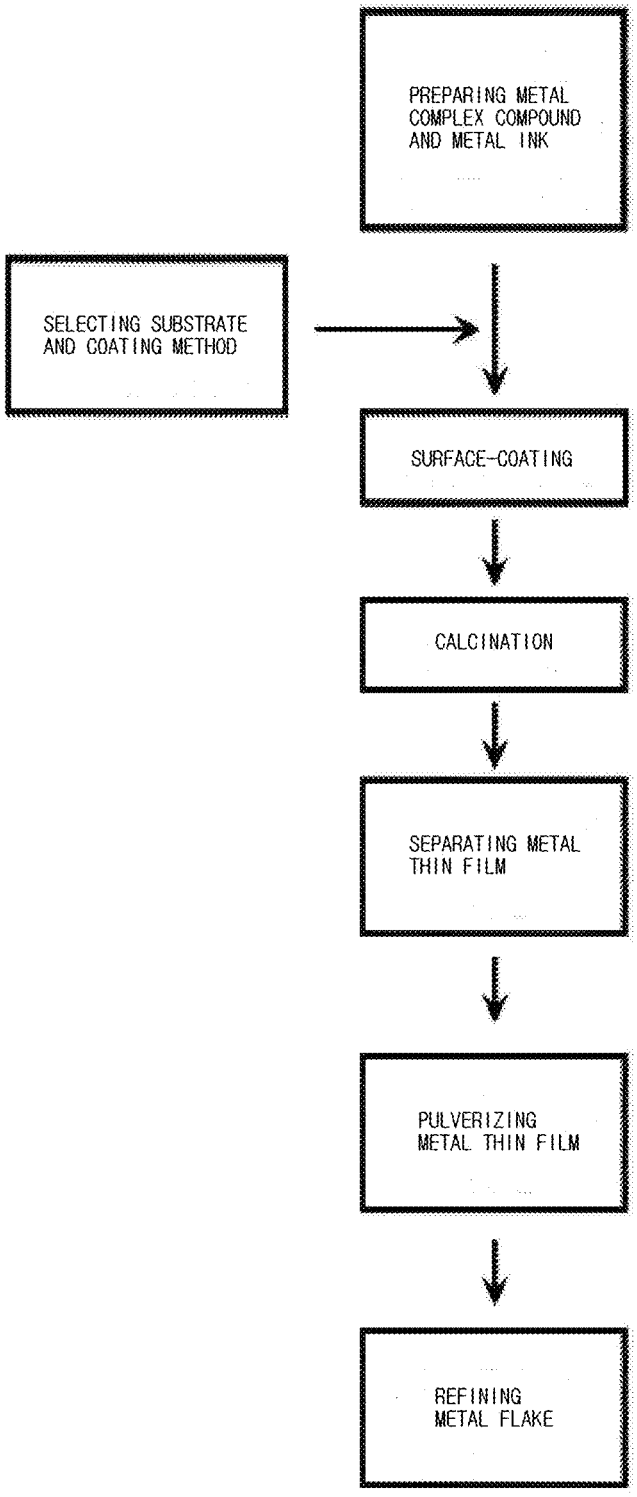
FIG. 1 is a flow chart showing a method of manufacturing metal flakes according to the present invention.
Figure 2:
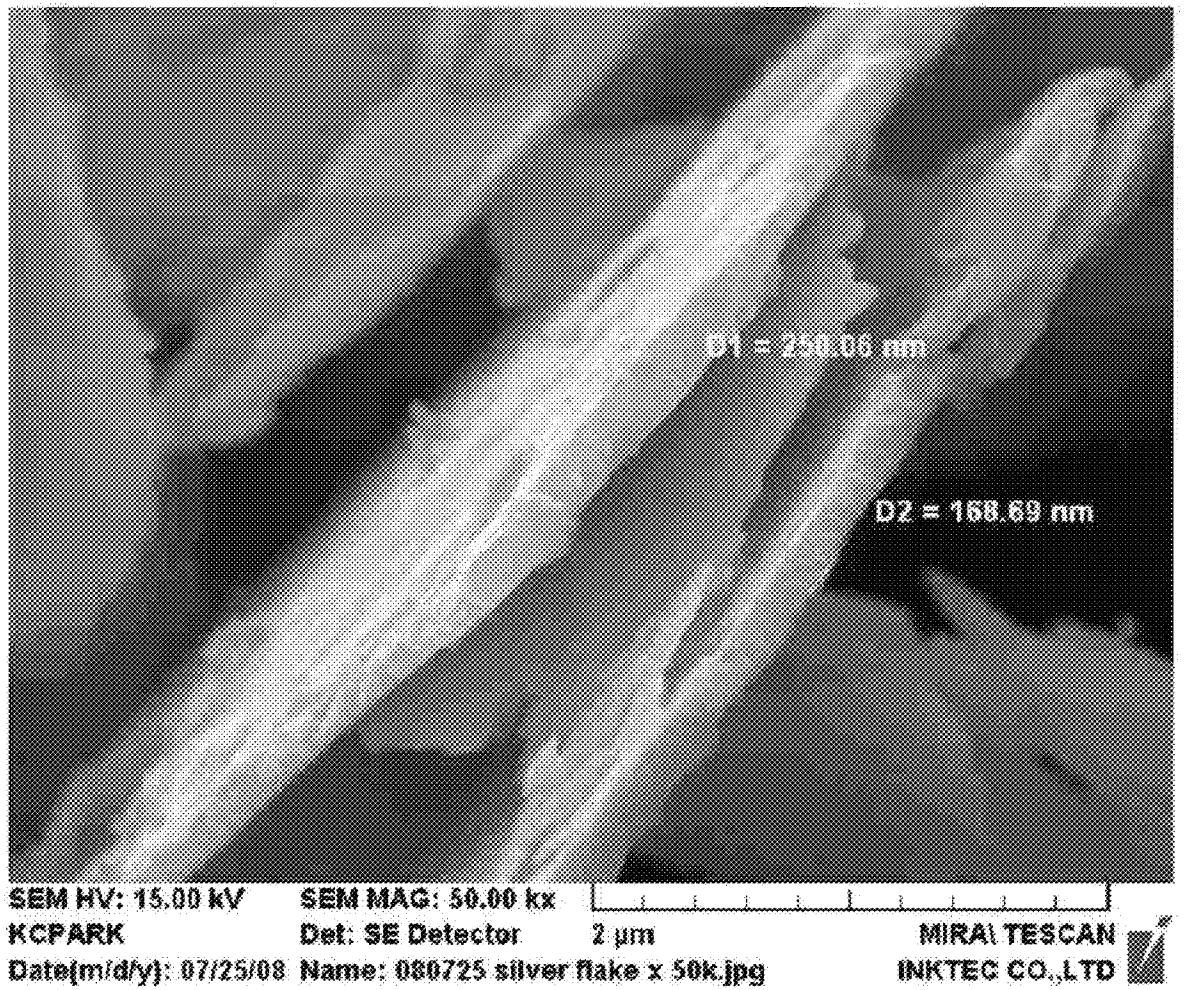
FIG. 2 is a SEM photograph showing the metal flake manufactured in Example 1.
Figure 3:
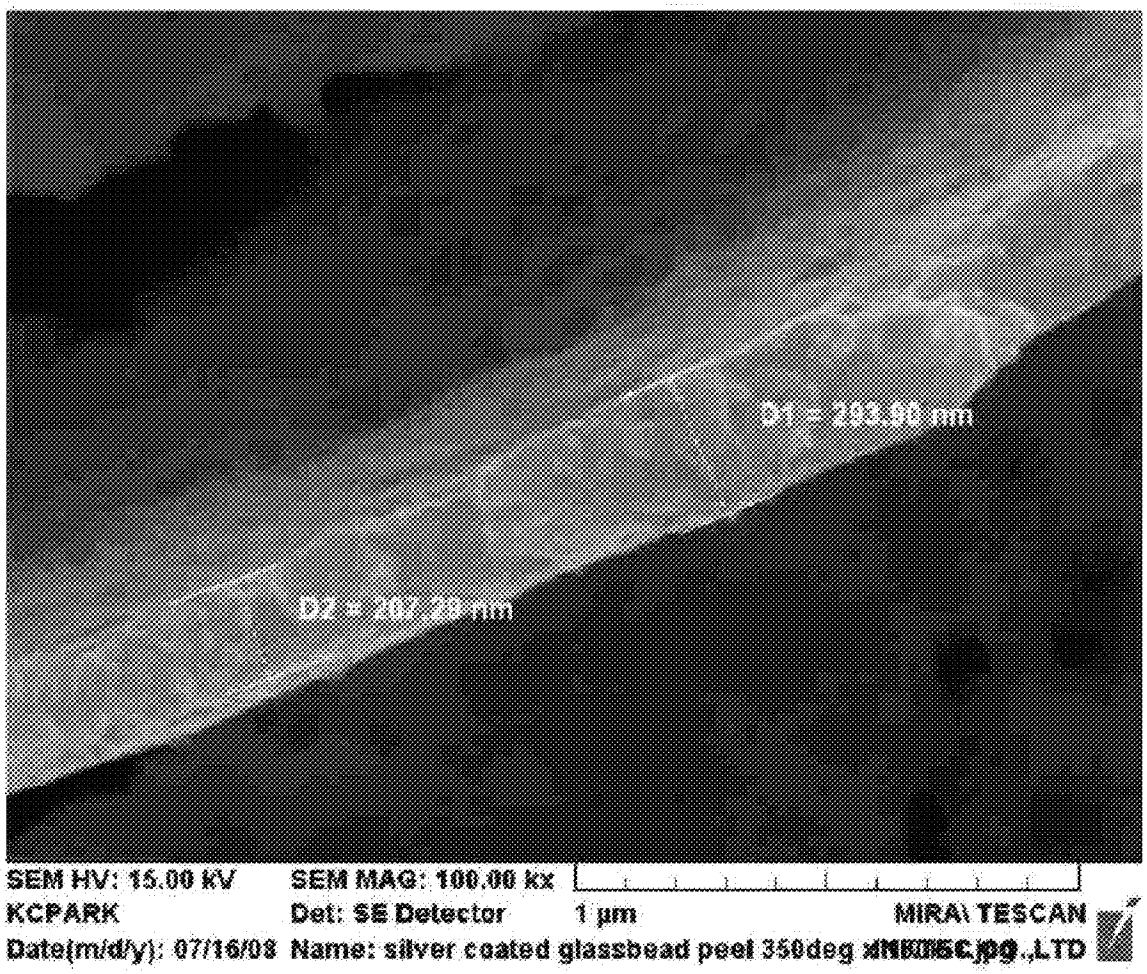
FIG. 3 is a SEM photograph showing the metal flake manufactured in Example 14.

The present invention relates to a method of manufacturing metal flakes, and, more particularly, to a method of manufacturing metal flakes using metal ink containing organic metal compounds. Hereinafter, preferred embodiments of the present invention will be described in detail with reference to the attached drawings.

The present invention provides a method of manufacturing a metal flake, including the steps of:

(a) applying metal ink containing an organic metal compound onto a substrate;

(b) calcining the metal ink applied on the substrate to form a thin metal film;

(c) separating the formed thin metal film from the substrate; and (d) pulverizing the separated thin metal film to form a metal flake.

The method of manufacturing a metal flake may further include the step of: refining the formed metal flake, after the step (d) of pulverizing the separated thin metal film.

Hereinafter, the method of manufacturing a metal flake according to the present invention will be described in more detail in steps.

(a) Applying Metal Ink Containing an Organic Metal Compound onto a Substrate

Metal ink containing a metal complex compound, which can be easily formed into a metal flake having uniform thickness and size and which has a special structure having low calcination temperature is used as the metal ink containing an organic metal compound of the present invention.

The present applicant filed a method of preparing a metal composite by reacting a metal compound with one or more selected from ammonium carbamate, ammonium carbonate and ammonium bicarbonate as Korean Patent Application No. 2005-34371. In the present invention, the metal ink containing a metal complex compound was prepared using the same method as in Korean Patent Application No. 2005-34371.

Korean Patent Application No. 2005-34371 provides a method of preparing a metal ink composition which can be formed into a thin film having uniform and compact micro patterns and high conductivity. Based on this method, the present inventors devised a method of manufacturing a metal flake having uniform thickness using a simple process.

The metal ink includes a metal complex compound obtained by reacting one or more metals or metal compounds represented by Formula 1 below with one or more ammonium compounds represented by Formula 1, 2 or 3 below:

$M_nX$ [Formula 1]

wherein M is a metal or metal alloy, n is an integer of 1~10, and X is non-existent or at least one substituent selected from hydrogen, ammonium, oxygen, sulfur, halogen, cyanide, cyanate, carbonate, nitrate, nitrite, sulfate, phosphate, thiocyanate, chlorate, perchlorate, tetrafluoroborate, acetylacetonate, mercapto, amide, alkoxide, carboxylate, and derivatives thereof.

[Formula 2]

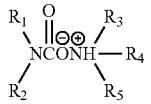

[Formula 3]

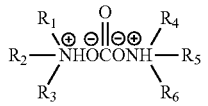

[Formula 4]

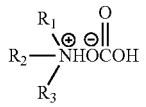

wherein R1, R2, R3, R4, R5 and R6 are each independently selected from hydrogen, a substituted or unsubstituted aliphatic alkyl group of C1~C30, an alicyclic alkyl group, an aryl group or aralkyl group, a polymer compound, a heterocyclic compound, and derivatives thereof; and R1 and R2 or R4 and R5 are connected with each other to form a ring.

The metal ink, if necessary, may further include at least one additive selected from a solvent, a stabilizer, a dispersant, a binder resin, a release agent, a reductant, a surfactant, a wetting agent, a thixotropic agent and a levelling agent in addition to the metal complex compound, metallic or nonmetallic compounds and at least one mixture thereof.

The solvent included in the metal ink may be selected from water, alcohols, glycols, acetate, ethers, ketones, aliphatic hydrocarbons, aromatic hydrocarbons, and halogenated hydrocarbons. Concretely, the solvent may be selected from water, methanol, ethanol, iso-propanol, 1-methoxypropanol, butanol, ethylhexyl alcohol, terpineol, ethylene glycol, glycerin, ethyl acetate, butyl acetate, methoxypropyl acetate, carbitol acetate, ethylcarbitol acetate, methyl cellosolve, butyl cellosolve, diethyl ether, tetrahydrofuran, dioxane, methyl ethyl ketone, acetone, dimethylformamide, 1-methyl-2-pyrrolidone, dimethyl sulfoxide, hexane, heptane, dodecane, paraffin oil, mineral spirits, benzene, toluene, xylene, chloroform, methylene chloride, carbon tetrachloride, and acetonitrile.

The substrate used in the present invention may be made of any material as long as it can realize the features of the present invention. For example, the substrate may be made of plastics such as polyimide (PI), polyethylene terephthalate (PET), polyethylene naphthalate (PEN), polyether sulfone (PES), nylon, polytetrafluoroethylene (PTFE), polyether ether ketone (PEEK), polyvinyl alcohol (PVA), polyethylene (PE), polypropylene (PP), polycarbonate (PC), polyarylate (PAR), and the like; resins such as an acrylic resin, a urethane resin, a fluorine resin, a silicon resin, an epoxy resin, a vinyl resin and the like; rubber materials such as butyl rubber, chloroprene rubber, styrene-butadiene rubber (SBR), ethylene-propylene rubber (EPR), SIS and the like; ceramic materials such as glass, silica, alumina, titanium oxides, zirconia, ceria, clay, stone, talc, mica and the like; metals or metal alloys such as aluminum, copper, nickel, iron, zinc, stainless, brass and the like; metal or nonmetal salts such as carbon, graphite, carbon nanotubes, silicon, sulfur, sodium hydroxide, barium sulfate and the like; papers such as synthetic paper, printing paper, packing paper, corrugated paper and the like; and composites thereof. Further, the substrate may be made in the form of powder, a flake, a bead, a ball, fiber, film, foil, a sheet, a chip, a rod, wire, a needle or a whisker. It is preferred that the substrate be shaped such that metal flakes are easily attached and detached, but the present invention is not particularly limited thereto.

The application of the metal ink containing a metal complex compound onto the substrate is conducted by spin coating, roll coating, spray coating, dip coating, flow coating, comma coating, kiss coating, die coating, a doctor blade method, dispensing, inkjet printing, offset printing, screen printing, pad printing, gravure printing, flexography, stencil printing, imprinting, xerography, lithography, fluidized bed coating, atomic layer deposition (ALD), chemical vapor deposition (CVD), physical vapor deposition (PVD), ion plasma coating, electrostatic coating or electro-deposition. However, the present invention is not particularly limited thereto.

Meanwhile, the thin film formed by applying the metal ink onto the substrate using the above coating method may have a thickness of 10 nm~100 μm, preferably, 50 nm~10 μm. Further, the thickness thereof can be adjusted by controlling the concentration of the metal ink, the coating amount of the metal ink or the coating speed of the metal ink. It is preferred that a substrate having excellent surface roughness be used in order to manufacture a high-gloss metal flake.

In order to easily separate metal flakes from a substrate, the application of the metal ink onto the substrate may be conducted using a mask or a patterned roll. For example, the substrate may be coated with the metal ink after it is patterned into a honeycomb structure or a mesh structure using a gravure process.

(b) Calcining the Metal Ink Applied on the Substrate to Form a Thin Metal Film

After the metal ink containing a metal complex compound having a special structure is applied onto a substrate (in step (a)), the metal ink applied on the substrate can be calcined by oxidation, reduction, heat treatment, hot air blowing, or irradiation of microwaves, infrared rays, ultraviolet rays, electron rays or laser.

The calcination of the metal ink may be conducted by heat treatment under a general inert atmosphere, but, if necessary, may be conducted by heat treatment under an air atmosphere, a nitrogen atmosphere, a carbon monoxide atmosphere, an atmosphere of a gas mixture of hydrogen and air, or an atmosphere of a gas mixture of hydrogen and another inert gas. When a metal complex compound, which is rapidly oxidized, is calcined, the calcination of the metal ink may be conducted after introducing a reductant such as hydrazine, hydrazine monohydrate, acetic hydrazide, sodium or potassium borohydride, trisodium citrate, methyldiethanolamine, ethanolamine, diethanolamine, propanolamine, butanolamine, hexanolamine, dimethylethanolamine, 2-amino-2-methyl propanol, dimethylamineborane, butylamineborane, piperidine, N-methylpiperidine, piperazine, N,N'-dimethylpiperazine, 1-amino-4-methylpiperazine, pyrrolidine, N-methylpyrrolidine, or morpholine. Further, the heat treatment may be conducted at 50~600° C., preferably 80~300° C., and more preferably 100~250° C. Additionally, in order to improve the uniformity of the thin metal film, the heat treatment may be conducted by two or more steps of low temperature and high temperature within the above temperature range. For instance, the heat treatment may be conducted at 80~150° C. for 1~30 minutes and then conducted 150~300° C. for 1~30 minutes.

The thickness of the thin metal film formed by calcining the metal ink may be, but is not limited to, 0.005~5 μm, preferably 0.01~1 μm, and preferably 0.05~0.5 μm. When the thickness thereof is less than 0.005 μm, the thin metal film is not uniform, and, when the thickness thereof is more than 5 μm, the manufacturing cost increases.

Meanwhile, the steps (a) and (b) may be successively conducted. For instance, the steps of forming a protective coating film on the obtained thin metal film, applying metal ink onto the protective coating film and then calcining the applied metal ink are repeated to form a multilayered thin metal film. Here, the protective coating film formed between the thin metal films must be easily attached, detached and dried, and must have excellent film characteristics. For example, the protective coating film must be easily melted by a solvent such as water or alcohol or easily melted or removed by heating such that it is easily separated from the substrate in subsequent processes. For this purpose, the protective coating film may be made of any one selected from polyvinyl alcohol (PVA), polyvinylpyrrolidone (PVP), a polyolefin resin, a urethane resin, an acrylic resin, a fluorine resin, a silicon resin, a polyvinyl ester resin, and wax.

(c) Separating the Thin Metal Film Formed in Step (b) from the Substrate

The method of separating the thin metal film from the substrate can be suitably selected depending on the kind of the substrate in step (a) and coating methods. For instance, the thin metal film (including a multilayered thin metal film), which was formed by applying metal ink onto a film-type substrate made of polyimide (PI), polyethylene terephthalate (PET), polyethylene naphthalate (PEN), polyether sulfone (PES), nylon, polytetrafluoroethylene (PTFE), polyether ether ketone (PEEK), polyvinyl alcohol (PVA), polyethylene (PE), polypropylene (PP), polycarbonate (PC), polyarylate (PAR) or the like using spin coating, roll coating, spray coating, dip coating, flow coating, comma coating, kiss coating, die coating, a doctor blade method, dispensing, inkjet printing, offset printing, screen printing, pad printing, gravure printing, flexography or the like and then calcining the metal ink applied on the film-type substrate in step (b), may be separated from the film-type substrate by a process of separating the thin metal film from the substrate using ultrasonic waves or a vibrator after immersing the thin metal film into a solvent such as salt water, alcohol, acetone or methyl ethyl ketone or a process of separating the thin metal film from the substrate using a metal stripping machine, thereby manufacturing a metal flake. Moreover, when the thin metal film is formed by release-coating the surface of the film-type substrate, this thin metal film may be separated from this film-type substrate using a scraper or an air gun.

In this case, the thin metal film may be immersed in the solvent for 1 minute~5 hours, preferably 5 minutes~3 hours, and more preferably 10 minutes~2 hours. When the immersion time is short, it may be difficult to form a metal flake having uniform thickness.

Further, the thin metal film, which was formed by applying metal ink onto a substrate in the shape of powder, a flake, a bead, a ball, fiber, a film, foil, a sheet, a chip, a rod, wire, a whisker or the like using spray coating, dip coating, fluidized bed coating, atomic layer deposition (ALD), chemical vapor deposition (CVD), physical vapor deposition (PVD), ion plasma coating, electrostatic coating, electro-deposition or the like, may be separated from the substrate by the frictional force between particles using a ball mill, thereby manufacturing a metal flake.

In addition to the above processes of separating the thin metal film, the thin metal film may be separated from the substrate using various processes, such as a chemical solution process, a process of blasting gas (air, nitrogen, etc.) or liquid (water, alcohol, etc.), a vacuum collecting process, and the like.

(d) Pulverizing the Thin Metal Film Separated in Step (c)

The method of manufacturing a metal flake having excellent conductivity and gloss by pulverizing the thin metal film separated in step (c) may be suitably used depending on the size or shape of metal particles and the application field thereof. For instance, the thin metal film separated in step (c) is formed into slurry using a solvent such as salt water, alcohol, glycol, acetone or the like, fatty acid, fatty acid salt, surfactant or the like, and then the slurry is mixed with media beads having a size of 0.7 mm or less using a bead mill and then stirred to manufacture metal flakes. In this case, metal flakes having excellent conductivity and gloss can be manufactured by adjusting the size and thickness of metal flake particles depending on the stirring speed and time of the bead mill and the size and material of the media beads.

When the size of the media beads is more than 0.7 mm, since the media beads become heavy, the pressure of the media beads onto the metal flake particles increases, and thus the frequency of the formation of thick and large metal flake particles greatly increases. Further, when the size of the media beads is less than 0.02 mm, the time required to form metal particles into metal flakes also increases, thus decreasing the productivity of metal flakes. Further, the media beads may be made of any one selected from zirconia, alumina and glass.

In addition to the above methods, the thin metal film may be pulverized into metal flakes using a high-speed mixer, a ball mill, a bead mill, an ultrasonic pulverizer or a micro-pulverizer depending on the size or shape of metal particles and the application field thereof.

The thickness and size of the metal flake manufactured in this way are not particularly limited. For instance, the thickness of the metal flake may be 0.005~5 μm, preferably 0.01~1 μm, and more preferably 0.05~0.5 μm. Further, the size of the metal flake may be 0.05~500 μm, preferably 0.1~300 μm, and more preferably 0.5~100 μm. Meanwhile, the gloss of the metal flakes is mostly determined by the calcination process, but is also influenced by the pulverizing process. Therefore, the gloss of the metal flake may not be particularly limited although it is preferred that the gloss thereof be excellent. That is, it is preferred that the metal flake have a reflectance of 30% or more.

Meanwhile, the method of manufacturing a metal flake may further include the step of: the step of refining the formed metal flake, after the step (d) of pulverizing the separated thin metal film. The step of refining the formed metal flake may be conducted in order to improve the purity of the metal flake, to improve the workability of the metal fake, to prevent the change of environment and to prevent the change of the metal flake over time. For instance, in order to improve the purity of the metal flake, the metal flake may be refined by removing impurities from the metal flake using a solvent or by surface-treating the metal flake. Further, in order to improve the workability of the metal flake and to prevent the change of the metal flake over time, the metal flake may be surface-treated with silica ($SiO_2$) sol; fatty acid such as oleic acid; a silicon compound such as methylsilyl isocyanate; a cellulose derivative such as polysaccharide; phosphoric acid; a phosphoric acid derivative such as phosphonic acid; or mercaptan (thiol group) provided with an alkyl group of 6 to 24 carbon atoms, such as 1-hexyl mercaptan, dodecyl mercaptan, lauryl mercaptan, hexdecyl mercaptan or octadecyl mercaptan; and mixtures thereof.

The surface treatment of the metal flake may be conducted by heat-treating the metal flake at a temperature of 50~500° C., preferably 80~300° C. in order to improve the physical properties of the metal flake.

The metal flakes refined in this way are classified by size using a polarized mesh and are then used in accordance with their application fields.

Hereinafter, the present invention will be described in more detail with reference to the following Examples. However, these Examples are set forth to illustrate the present invention, and the scope of the present invention is not limited thereto.

Preparation Example 1

Preparation of Metal Ink 1

34.89 g (129.8 mmol) of viscous liquid containing 2-ethylhexylammonium 2-ethylhexyl carbamate and butylammonium butyl carbamate at a molar ratio of 7:3 was put into a 250 mL Schlenk flask provided with a stirrer, and then 12.03 g (51.92 mmol) of silver oxide, manufactured by Aldrich Chemical Co. Inc., was added thereto. Subsequently, the mixed solution was stirred and reacted at room temperature for 2 hours. During the reaction, the color of the black suspension (slurry) was gradually lightened due to the production of a complex compound, and, finally, 46.92 g of a yellow transparent silver complex solution was obtained. As the result of thermogravimetric analysis (TGA) of the silver complex solution, the content of silver in the silver complex solution was 23.65 wt %. Subsequently, this silver complex solution was diluted with IPA, thereby preparing metal ink 1 having a silver content of 10 wt % and a viscosity of 14 cps.

Preparation Example 2

Preparation of Metal Ink 2

28.06 g (0.876 mol) of methanol and 13.88 g (52.14 mmol) of viscous liquid containing 2-ethylhexylammonium 2-ethylhexyl carbamate and amylammonium amyl carbamate at a molar ratio of 7:3 were put into a 250 mL Schlenk flask provided with a stirrer, and then 8.06 g (34.76 mmol) of silver oxide, manufactured by Aldrich Chemical Co. Inc., was added thereto. Subsequently, the mixed solution was stirred and reacted at room temperature for 2 hours. During the reaction, the color of the black suspension (slurry) was gradually lightened due to the production of a complex compound, and, finally, 50 g of a yellow transparent silver complex solution having low viscosity was obtained. As the result of thermogravimetric analysis (TGA) of the silver complex solution, metal ink 2 having a silver content of 14.99 wt % and a viscosity of 9 cps was prepared.

Preparation Example 3

Preparation of Metal Ink 3

58.93 g of the metal ink 1 prepared in Preparation Example 1 and 41.07 g of silver nanoparticles, manufactured by Ferro Chemical Co. Inc., were put into a 250 mL Schlenk flask provided with a stirrer, and were then primarily stirred at room temperature for 30 minutes. Subsequently, the mixed solution was secondarily stirred by a three roll mill, thereby preparing metal ink 3 having a silver content of 55 wt % and a viscosity of 6000 cps (Brook field DV II pro, 15 spindle, 50 rpm).

Preparation Example 4

Preparation of Metal Ink 4

7.53 g (41.88 mmol) of isopropylammonium isopropyl carbonate was dissolved in 20.00 mL of methanol and 1.89 g of a hydrogen peroxide solution (50 wt %) in a 250 mL Schlenk flask provided with a stirrer, and then 1.00 g (6.98 mmol) of copper(I) oxide was added thereto. Subsequently, the mixed solution was stirred and reacted at room temperature for 2 hours. During the reaction, the color of the brown suspension (slurry) was gradually lightened, and, finally, a blue transparent reaction solution was obtained. Subsequently, a solvent was completely removed from the reaction solution under vacuum to obtain 6.28 g of a blue copper complex compound. As the result of thermogravimetric analysis (TGA) of the copper complex compound, metal ink 4 having a copper content of 14.17 wt % and a viscosity of 20 cps was prepared.

Preparation Example 5

Preparation of Metal Ink 5

1.00 g (7.71 mmol) of nickel(II) chloride hexahydrate was dissolved in 5.00 mL of an aqueous solution to form an aqueous nickel(II) chloride solution in a 250 mL Schlenk flask provided with a stirrer, and then a solution in which 5.83 g (19.27 mmol) of 2-ethylhexylammonium 2-ethylhexyl carbamate as a viscous liquid was dissolved in 10.00 mL of benzene was added to the aqueous nickel(II) chloride solution. Subsequently, the mixed solution was stirred and reacted at room temperature for 2 hours. During the reaction, the green suspension (slurry) was changed to a white suspension (slurry). After the reaction, the reaction solution was separated into a colorless transparent aqueous solution and a green transparent organic solvent. Then, only the organic solvent was completely removed under vacuum to obtain 4.73 g of a dark green nickel complex compound. As the result of thermogravimetric analysis (TGA) of the nickel complex compound, metal ink 5 having a nickel content of 14.54 wt % and a viscosity of 17 cps was prepared.

Preparation Example 6

Preparation of Metal Ink 6

1.00 g (5.64 mmol) of palladium(II) chloride was dissolved in 5.00 mL of an aqueous solution to form an aqueous palladium(II) chloride solution in a 250 mL Schlenk flask provided with a stirrer, and then a solution in which 1.71 g (16.92 mmol) of 2-ethylhexylammonium 2-ethylhexyl carbamate as a viscous liquid was dissolved in 5.00 mL of ethyl acetate was added to the aqueous palladium(II) chloride solution. Subsequently, the mixed solution was stirred and reacted at room temperature for 2 hours. During the reaction, the red suspension (slurry) was changed to a colorless suspension (slurry). After the reaction, the reaction solution was separated into a colorless transparent aqueous solution and a colorless transparent organic solvent. Then, only the organic solvent was completely removed under vacuum to obtain 2.22 g of a yellow transparent palladium complex compound. As the result of thermogravimetric analysis (TGA) of the palladium complex compound, metal ink 6 having a palladium content of 10.80 wt % and a viscosity of 25 cps was prepared.

Example 1

In order to manufacture metal flakes, after a PET film coated with a release agent, having a width of 300 mm and a length of 200 m was provided, the PET film was coated with the metal ink 1 at a coating speed of 20 m/s using a micro gravure coating machine and then calcined at 150° C. to form a thin silver film having a reflectance of 97% on the surface of the PET film. In order to separate the thin silver film from the PET film, the thin silver film was immersed in 10% salt water for 30 minutes and simultaneously separated from the PET film using an ultrasonic vibrator and then sufficiently washed with water to obtain irregular-sized silver flakes. These irregular-sized silver flakes were put into a bead mill charged with zirconium media beads having a size of 0.1 mm and then stirred to manufacture silver flakes having a thickness of 0.2 μm and a size of 7 μm. The manufactured silver flakes were immersed for 30 seconds in a mixed solution of 5% hexadecyl mercaptan (manufactured by Aldrich Chemical Co., Inc.) and ethanol, thus finally obtaining surface-treated silver flakes.

Example 2

In order to manufacture metal flakes, after a PI film having a width of 300 mm and a length of 200 m was provided, the PI film was coated with the metal ink 1 at a coating speed of 20 m/s using a micro gravure coating machine to form a thin silver film having a reflectance of 97% on the surface of the PI film. In order to separate the thin silver film from the PI film, the thin silver film was easily separated from the PI film using an air gun and then sufficiently washed with water to obtain irregular-sized silver flakes. These irregular-sized silver flakes were put into a bead mill charged with zirconium media beads having a size of 0.3 mm and then stirred to manufacture silver flakes having a thickness of 0.2 μm and a size of 20 μm. The manufactured silver flakes were immersed for 30 seconds in a mixed solution of 5% oleic acid (manufactured by Aldrich Chemical Co., Inc.) and ethanol, thus finally obtaining refined silver flakes.

Example 3

In order to manufacture metal flakes, after a PET film having a width of 300 mm and a length of 200 m was provided, the PET film was coated with a mixed solution of the metal ink 1 and a 1% solvent dye (ORASOL BLUE GN, manufactured by Ciba Chemical Co. Inc.) at a coating speed of 20 m/s using a micro gravure coating machine to form a thin metal film having reflectance of 75% on the surface of the PET film. The thin metal film was immersed in 10% salt water for 30 minutes and simultaneously separated from the PET film using an ultrasonic vibrator and then sufficiently washed with water to obtain a glossy blue thin metal film. This glossy blue thin metal film was put into a bead mill charged with zirconium media beads having a size of 0.3 mm and then stirred to manufacture metal flakes having a thickness of 0.2 μm and a size of 20 μm.

Example 4

In order to manufacture metal flakes, after a PET film having a width of 300 mm and a length of 200 m was provided, the PET film was coated with a mixed solution of 9 g of the metal ink 1 and 1 g of a 4% calcium naphthenate (manufactured by Chinyang Chemical Co. Inc.) in a honeycomb pattern having a line width of 80 μm and a line interval of 150 μm at a coating speed of 20 m/s using a micro gravure coating machine to form a thin metal film having a reflectance of 70% on the surface of the PET film. The thin metal film was immersed in 10% salt water for 30 minutes and simultaneously separated from the PET film using an ultrasonic vibrator and then sufficiently washed with water to obtain a glossy blue thin metal film. This glossy blue thin metal film was put into a bead mill charged with zirconium media beads having a size of 0.3 mm and then stirred to manufacture metal flakes having a thickness of 0.1 μm and a size of 20 μm.

Example 5

In order to manufacture metal flakes, after a PET film coated with a release agent, having a width of 300 mm and a length of 200 m was provided, the PET film was coated with the metal ink 1 at a coating speed of 20 m/s using a micro gravure coating machine and then calcined at 150° C. to form a thin silver film having a reflectance of 97% on the surface of the PET film. Thereafter, the thin silver film was coated with a 20% polyvinyl alcohol resin solution at a coating speed of 20 m/s using a micro gravure coating machine, dried and then further coated with the metal ink 1 using the above method to form a two-layered thin silver film. In order to separate the thin silver film from the PET film, the thin silver film was immersed in 10% salt water for 30 minutes and simultaneously separated from the PET film using an ultrasonic vibrator and then sufficiently washed with water to obtain irregular-sized silver flakes. These irregular-sized silver flakes were put into a bead mill charged with zirconium media beads having a size of 0.1 mm and then stirred to manufacture silver flakes having a thickness of 0.2 μm and a size of 7 μm.

Example 6

In order to manufacture metal flakes, after a PET film having a size of 5 cm×5 cm was provided, dust was removed from the surface of the PET film using ethanol, and then the PET film was dried at 50° C. for 5 minutes using a drier. Subsequently, the metal ink 1 (5 mL) was applied onto the dried PET film, and then this PET film was rotated at a rotation speed of 500 rpm for 20 seconds by a spin coater to form a thin silver film on the surface of the PET film, and then this thin silver film was calcined at 150° C. for 5 minutes to form a thin silver film having a reflectance of 98%. In order to separate the thin silver film from the PET film, the thin silver film was immersed in 10% salt water for 30 minutes and simultaneously separated from the PET film using an ultrasonic vibrator and then sufficiently washed with water to obtain irregular-sized silver flakes. These processes were repeated to obtain 10 g of irregular-sized silver flakes. These irregular-sized silver flakes were put into a bead mill charged with zirconium media beads having a size of 0.3 mm and then stirred to manufacture silver flakes having a thickness of 0.3 μm and a size of 20 μm.

Example 7

In order to manufacture metal flakes, after an Al-deposited PET film having a size of 5 cm×5 cm was provided, dust was removed from the surface of the Al-deposited PET film using ethanol, and then the Al-deposited PET film was dried at 50° C. for 5 minutes using a drier. Subsequently, a mixed solution of 19 g of the metal ink 1 and 1 g of 8% zirconium octoate (manufactured by Chinyang Chemical Co., Inc.) was applied onto the dried Al-deposited PET film (thickness: 25 μm), and then this PET film was rotated at a rotation speed of 500 rpm for 20 seconds by a spin coating machine to form a thin metal film on the surface of the Al-deposited PET film, and then this thin metal film was calcined at 150° C. for 5 minutes to form a glossy thin metal film having a reflectance of 40%. In order to separate the thin metal film from the Al-deposited PET film, the thin metal film was immersed in 10% salt water for 5 minutes and separated from the PET film using an air gun and then sufficiently washed with water to obtain irregular-sized metal flakes. These processes were repeated to obtain 10 g of irregular-sized metal flakes. These irregular-sized metal flakes were put into a bead mill charged with zirconium media beads having a size of 0.3 mm and then stirred to manufacture metal flakes having a thickness of 0.3 μm and a size of 20 μm.

Example 8

In order to manufacture metal flakes, after a PET film having a width of 300 mm and a length of 200 m was provided, the PET film was coated with the metal ink 1 at a coating speed of 10 m/s using a flexo coating machine to form a thin silver film having a reflectance of 97% on the surface of the PET film. In order to separate the thin silver film from the PET film, the thin silver film was immersed in 10% salt water for 30 minutes and simultaneously separated from the PET film using an ultrasonic vibrator and then sufficiently washed with water to obtain irregular-sized silver flakes. These irregular-sized silver flakes were put into a bead mill charged with zirconium media beads having a size of 0.2 mm and then stirred to manufacture silver flakes having a thickness of 0.12 μm and a size of 10 μm.

Example 9

In order to manufacture metal flakes, after a PET film having a size of 5 cm×5 cm was provided, dust was removed from the surface of the PET film, and then the PET film was dried at 50° C. for 5 minutes using a drier. Subsequently, the dried PET film was coated with the metal ink 2 in a predetermined dot pattern having a diameter of 15 μm using an inkjet printer mounted with a dimatix DMP-2831 1pl head to form a thin silver film on the surface of the PET film, and then this thin silver film was calcined at 150° C. for 5 minutes to form a thin silver film having a reflectance of 90%. In order to separate the thin silver film from the PET film, the thin silver film was immersed in 10% salt water for 30 minutes and simultaneously separated from the PET film using an ultrasonic vibrator and then sufficiently washed with water to obtain patterned silver flakes having a thickness of 0.35 μm and a size of 15 μm without using a pulverizing process. These processes were repeated to obtain 10 g of patterned silver flakes.

Example 10

In order to manufacture metal flakes, after a glass plate was provided, dust was removed from the surface of the glass plate using ethanol, and then the glass plate was dried at 50° C. for 5 minutes using a drier. Subsequently, the glass plate was coated with the metal ink 3 using a 400 mesh screen printer to form a thin silver film on the surface of the glass plate, and then this thin silver film was calcined at 150° C. for 5 minutes to form a thin silver film having a reflectance of 45%. In order to separate the thin silver film from the glass plate, the thin silver film was immersed in 10% salt water for 1 hour and simultaneously separated from the glass plate using an ultrasonic vibrator and then sufficiently washed with water to obtain irregular-sized silver flakes. These processes were repeated to obtain 10 g of irregular-sized silver flakes. These irregular-sized silver flakes were put into a bead mill charged with zirconium media beads having a size of 0.5 mm and then stirred to manufacture silver flakes having a thickness of 1 μm and a size of 40 μm.

Example 11

In order to manufacture metal flakes, after a stainless steel sheet having a width of 1 m and a length of 3 m, from which dust was removed, was provided, the stainless steel sheet was coated with the metal ink 1 using a spray coating machine on a conveyor belt to form a thin silver film on the surface of the stainless steel sheet, and then this thin silver film was calcined at 150° C. for 5 minutes to form a thin silver film having a reflectance of 95%. In order to separate the thin silver film from the stainless steel sheet, the thin silver film was immersed in 10% salt water for 1 hour and simultaneously separated from the stainless steel sheet using an ultrasonic vibrator and then sufficiently washed with water to obtain irregular-sized silver flakes. These processes were repeated to obtain 10 g of irregular-sized silver flakes. These irregular-sized silver flakes were put into a bead mill charged with zirconium media beads having a size of 0.2 mm and then stirred to manufacture silver flakes having a thickness of 0.3 μm and a size of 10 μm.

Example 12

In order to manufacture metal flakes, after zirconia beads having a size of 0.3 mm, from which dust was removed, were provided, the zirconia beads and the metal ink 1 were put into a fluidized-bed reactor and then heated to 110° C., and then the zirconia beads were coated with the metal ink 1 for 20 minutes to form a thin silver film, and then this thin silver film was calcined at 150° C. for 5 minutes to form a thin silver film having a reflectance of 88%. In order to separate the thin silver film, the thin silver film was immersed in 10% salt water for 1 hour and simultaneously separated using an ultrasonic vibrator and then sufficiently washed with water, to obtain irregular-sized silver flakes. These irregular-sized silver flakes were put into a bead mill charged with zirconium media beads having a size of 0.2 mm and then stirred to manufacture silver flakes having a thickness of 0.2 μm and a size of 10 μm.

Example 13

In order to manufacture metal flakes, after mica beads having a size of 80 μm, from which dust was removed, were provided, the mica beads and a mixed solution of 1 kg of the metal ink 1 and 30 g of 3-aminopropyltriethoxysilane (manufactured by Aldrich Chemical Co., Inc.) were put into a fluidized-bed reactor and then heated to 110° C., and then the zirconia beads were coated with the metal ink 1 for 20 minutes to form a thin metal film, and then this thin metal film was calcined at 150° C. for 5 minutes to form a thin metal film having a reflectance of 45%. In order to separate the thin metal film, the thin metal film was immersed in 10% salt water for 1 hour and simultaneously separated using an ultrasonic vibrator and then sufficiently washed with water to obtain irregular-sized metal flakes. These irregular-sized metal flakes were put into a bead mill charged with zirconium media beads having a size of 0.2 mm and then stirred to manufacture light red metal flakes having a thickness of 0.2 μm and a size of 10 μm.

Example 14

In order to manufacture metal flakes, after glass beads having a size of 0.3 mm, from which dust was removed, were provided, the glass beads and the metal ink 1 were put into a fluidized-bed reactor and then heated to 110° C., and then the glass beads were coated with the metal ink 1 for 20 minutes to form a thin metal film, and then this thin metal film was calcined at 150° C. for 5 minutes to form a thin metal film having a reflectance of 88%. Thereafter, the thin metal film was coated with a 10% polyvinylpyrrolidone solution using a fluidizing coating machine, and then further coated with the metal ink 1 using the above method to form a two-layered thin metal film. In order to separate the thin metal film, the thin metal film was immersed in 10% salt water for 1 hour and simultaneously separated using an ultrasonic vibrator and then sufficiently washed with water to obtain irregular-sized metal flakes. These irregular-sized metal flakes were put into a bead mill charged with zirconium media beads having a size of 0.2 mm and then stirred to manufacture metal flakes having a thickness of 0.25 μm and a size of 10 μm.

Example 15

In order to manufacture metal flakes, after a polyester fiber nonwoven fabric having a width of 1 m and a length of 200 m, from which dust was removed, were provided, the polyester fiber nonwoven fabric was coated with the metal ink 1 using a roll dip coating machine charged with the metal ink 1 to form a thin silver film on the surface of the polyester fiber nonwoven fabric, and then this thin silver film was calcined at 150° C. for 5 minutes to form a thin silver film having a reflectance of 81%. In order to separate the thin silver film from the polyester fiber nonwoven fabric, the thin silver film was immersed in 10% salt water for 1 hour and simultaneously separated from the polyester fiber nonwoven fabric using an ultrasonic vibrator and then sufficiently washed with water, to obtain irregular-sized silver flakes. These irregular-sized silver flakes were put into a bead mill charged with zirconium media beads having a size of 0.3 mm and then stirred to manufacture silver flakes having a thickness of 0.4 μm and a size of 20 μm.

Example 16

Metal flakes were manufactured in the same manner as in Example 1 except that they were manufactured using the metal ink 4. The metal flakes have a thickness of 0.2 μm and a size of 7 μm.

Example 17

Metal flakes were manufactured in the same manner as in Example 16 except that they were manufactured by conducting the calcination using a 10% hydrazine solution. The metal flakes have a thickness of 0.2 μm and a size of 6 μm.

Example 18

Metal flakes were manufactured in the same manner as in Example 1 except that they were manufactured using the metal ink 5. The metal flakes have a thickness of 0.3 μm and a size of 5 μm.

Example 19

Metal flakes were manufactured in the same manner as in Example 1 except that they were manufactured using the metal ink 6. The metal flakes have a thickness of 0.25 μm and a size of 5 μm.

As described above, the method of manufacturing a metal flake according to the present invention is advantageous in that the thickness and size of metal flakes can be easily adjusted, metal flakes having excellent conductivity and gloss can be obtained, and metal flakes can be mass-produced using environmentally friendly and economical methods.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of manufacturing a metal flake, comprising the steps of:

applying metal ink containing a metal complex compound obtained by reacting one or more metals or metal compounds represented by Formula 1 below with one or more ammonium compounds represented by Formula 2, 3 or 4 below onto a substrate;

calcining the metal ink applied on the substrate to form a thin metal film;

separating the formed thin metal film from the substrate; and pulverizing the separated thin metal film using a bead mill, an ultrasonic pulverizer or a micro pulverizer to form a metal flake having a thickness of 0.01 to 1 μm, a size of 0.5 to 100 μm and a reflectance of 30% or more, wherein the bead mill is charged with media beads made of zirconia, alumina or glass and having a size of 0.02 to 0.7 mm, and wherein the step of separating the thin metal film from the substrate is conducted by a process of separating the thin metal film from the substrate using ultrasonic waves or a vibrator after immersing the thin metal film formed on the substrate into salt water, or a process of separating the thin metal film from the substrate using a scraper or an air gun;

$M_nX$ Formula 1 wherein M is a metal or metal alloy, n is an integer of 1-10, and X is non-existent or at least one substituent selected from hydrogen, ammonium, oxygen, sulfur, halogen, cyanide, cyanate, carbonate, nitrate, nitrite, sulfate, phosphate, thiocyanate, chlorate, perchlorate, tetrafluoroborate, acetylacetonate, mercapto, amide, alkoxide, carboxylate, and derivatives thereof;

Formula 2

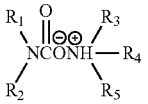

Formula 3

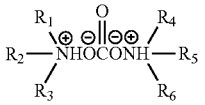

Formula 4

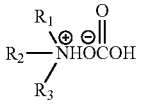

wherein $R_1$, $R_2$, $R_3$, $R_4$, $R_5$ and $R_6$ are each independently selected from hydrogen, a substituted or unsubstituted aliphatic alkyl group of C1-C30, an alicyclic alkyl group, an aryl group or aralkyl group, a polymer compound, a heterocyclic compound, and derivatives thereof; and $R_1$ and $R_2$ or $R_4$ and $R_5$ are connected with each other to form a ring.

2. The method of manufacturing a metal flake according to claim 1, further comprising the step of: refining the formed metal flake, after the step of pulverizing the separated thin metal film.

3. The method of manufacturing a metal flake according to claim 2, wherein the step of refining the pulverized thin metal film is conducted by removing impurities from the metal flake using a solvent or by surface-treating the metal flake.

4. The method of manufacturing a metal flake according to claim 3, wherein the pulverized thin metal film is surface-treated with fatty acid, a silicon compound, a cellulose derivative, phosphoric acid, a phosphoric acid derivative, or mercaptan (thiol group) provided with an alkyl group of 6 to 24 carbon atoms.

5. The method of manufacturing a metal flake according to claim 4, wherein the fatty acid is oleic acid; the silicon compound is methylsilyl isocyanate; the cellulose derivative is polysaccharide; the phosphoric acid derivative is phosphonic acid; and the mercaptan (thiol group) provided with an alkyl group of 6 to 24 carbon atoms is 1-hexyl mercaptan, dodecyl mercaptan, lauryl mercaptan, hexdecyl mercaptan or octadecyl mercaptan.

6. The method of manufacturing a metal flake according to claim 1, wherein the metal ink includes at least one selected from the metal complex compound, metallic or nonmetallic compounds and at least one mixture thereof, and wherein the metal ink includes at least one additive selected from the group consisting of a solvent, a stabilizer, a dispersant, a binder resin, a release agent, a reductant, a surfactant, a wetting agent, a thixotropic agent, and a levelling agent.

7. The method of manufacturing a metal flake according to claim 6, wherein the solvent is selected from the group consisting of water, alcohols, glycols, acetate, ethers, ketones, aliphatic hydrocarbons, aromatic hydrocarbons, and halogenated hydrocarbons.

8. The method of manufacturing a metal flake according to claim 6, wherein the solvent is selected from the group consisting of methanol, ethanol, iso-propanol, 1-methoxypropanol, butanol, ethylhexyl alcohol, terpineol, ethylene glycol, glycerin, ethyl acetate, butyl acetate, methoxypropyl acetate, carbitol acetate, ethylcarbitol acetate, methyl cellosolve, butyl cellosolve, diethyl ether, tetrahydrofuran, dioxane, methyl ethyl ketone, acetone, dimethylformamide, 1-methyl-2-pyrrolidone, dimethyl sulfoxide, hexane, heptane, dodecane, paraffin oil, mineral spirits, benzene, toluene, xylene, chloroform, methylene chloride, carbon tetrachloride, and acetonitrile.

9. The method of manufacturing a metal flake according to claim 1, wherein the substrate is made of a material selected from the group consisting of plastics, resins, rubber materials, ceramic materials, metals or metal alloys, metal or nonmetal salts, papers, and composites thereof.

10. The method of manufacturing a metal flake according to claim 9, wherein the plastics are selected from the group consisting of polyimide (PI), polyethylene terephthalate (PET), polyethylene naphthalate (PEN), polyether sulfone (PES), nylon, polytetrafluoroethylene (PTFE), polyether ether ketone (PEEK), polyvinyl alcohol (PVA), polyethylene (PE), polypropylene (PP), polycarbonate (PC), and polyarylate (PAR); the resins are selected from the group consisting of an acrylic resin, an urethane resin, a fluorine resin, a silicon resin, an epoxy resin, and a vinyl resin; the rubber materials are selected from the group consisting of butyl rubber, chloroprene rubber, styrene-butadiene rubber (SBR), ethylene-propylene rubber (EPR), and styrene-isoprene-styrene (SIS); the ceramic materials are selected from the group consisting of glass, silica, alumina, titanium oxides, zirconia, ceria, clay, stone, talc, and mica; the metals or metal alloys include aluminum, copper, nickel, iron, zinc, stainless, and brass; the metal or nonmetal salts are selected from the group consisting of sodium hydroxide and barium sulfate; and the papers are selected from the group consisting of synthetic paper, printing paper, packing paper, and corrugated paper.

11. The method of manufacturing a metal flake according to claim 1, wherein the substrate is made in the form of powder, a flake, a bead, a ball, fiber, film, foil, a sheet, a chip, a rod, wire, a needle or a whisker.

12. The method of manufacturing a metal flake according to claim 1, wherein the step of applying the metal ink onto the substrate is conducted by spin coating, roll coating, spray coating, dip coating, flow coating, comma coating, kiss coating, die coating, a doctor blade method, dispensing, inkjet printing, offset printing, screen printing, pad printing, gravure printing, flexography, stencil printing, imprinting, xerography, lithography, fluidized bed coating, atomic layer deposition (ALD), chemical vapor deposition (CVD), physical vapor deposition (PVD), ion plasma coating, electrostatic coating or electro-deposition.

13. The method of manufacturing a metal flake according to claim 1, wherein the step of calcining the applied metal ink is conducted by oxidation, reduction, heat treatment, hot air blowing, or irradiation of microwaves, infrared rays, ultraviolet rays, or laser.

14. The method of manufacturing a metal flake according to claim 1, wherein the step of calcining the applied metal ink comprises the step of introducing a reductant.

15. The method of manufacturing a metal flake according to claim 14, wherein the reductant comprises at least one of hydrazine, hydrazine monohydrate, acetic hydrazide, sodium or potassium borohydride, trisodium citrate, methyldiethanolamine, ethanolamine, diethanolamine, propanolamine, butanolamine, hexanolamine, dimethylethanolamine, 2-amino-2-methyl propanol, dimethylamineborane, butylamineborane, piperidine, N-methylpiperidine, piperazine, N,N'-dimethylpiperazine, 1-amino-4-methylpiperazine, pyrrolidine, N-methylpyrrolidine, and morpholine.

16. The method of manufacturing a metal flake according to claim 1, wherein the thin metal film formed by calcining the applied metal ink has a thickness of 0.005~5 μm.

17. The method of manufacturing a metal flake according to claim 1, wherein, in the step of applying the metal ink and the step of calcining the applied metal ink, the steps of forming a protective coating film on the obtained thin metal film, applying metal ink onto the protective coating film and then calcining the applied metal ink are repeated to form a multilayered thin metal film.

18. The method of manufacturing a metal flake according to claim 17, wherein the protective coating film is made of any one selected from the group consisting of polyvinyl alcohol (PVA), polyvinylpyrrolidone (PVP), a polyolefin resin, a urethane resin, an acrylic resin, a fluorine resin, a silicon resin, a polyvinyl ester resin, and wax.

19. The method of manufacturing a metal flake according to claim 17, wherein the step of applying the metal ink onto the substrate is conducted by entire coating or pattern coating.

20. The method of manufacturing a metal flake according to claim 1, wherein the step of applying the metal ink onto the substrate is conducted by entire coating or pattern coating.

21. The method of manufacturing a metal flake according to claim 20, wherein, in the pattern coating, the pattern is a honeycomb structure or a mesh structure.

22. The method of manufacturing a metal flake according to claim 1, wherein the substrate is made of carbon, graphite, carbon nanotubes, silicon, or sulfur.

* * * * *